US011300300B2

(12) United States Patent
Weber

(10) Patent No.: US 11,300,300 B2
(45) Date of Patent: Apr. 12, 2022

(54) DYNAMIC QUALITY MANAGEMENT/MONITORING SYSTEM OF A COMMERCIAL COOKING APPLIANCE

(71) Applicant: Convotherm-Elektrogeräte GmbH, Eglfing (DE)

(72) Inventor: Ludwig Weber, Mindelheim (DE)

(73) Assignee: CONVOTHERM-ELEKTROGERAETE GMBH, Eglfing (DE)

( * ) Notice: Subject to any disclaimer, the term of this patent is extended or adjusted under 35 U.S.C. 154(b) by 232 days.

(21) Appl. No.: 16/094,225

(22) PCT Filed: Mar. 20, 2017

(86) PCT No.: PCT/EP2017/056579
§ 371 (c)(1),
(2) Date: Oct. 17, 2018

(87) PCT Pub. No.: WO2017/182214
PCT Pub. Date: Oct. 26, 2017

(65) Prior Publication Data

US 2019/0093901 A1 Mar. 28, 2019

(30) Foreign Application Priority Data

Apr. 18, 2016 (DE) ..... 102016206483.5

(51) Int. Cl.
*F24C 14/00* (2006.01)
*F24C 7/08* (2006.01)
(Continued)

(52) U.S. Cl.
CPC ..... *F24C 14/00* (2013.01); *F24C 7/085* (2013.01); *F27D 21/02* (2013.01); *F27D 25/00* (2013.01); *F27D 2021/026* (2013.01)

(58) Field of Classification Search
CPC ..... F24C 14/00; F24C 7/085; F27D 21/02; F27D 2021/026; H05B 6/6464;
(Continued)

(56) References Cited

U.S. PATENT DOCUMENTS 6,587,575 B1 * 7/2003 Windham ..... G01N 33/12 382/110
8,178,142 B2 5/2012 Greiner et al.
(Continued)

FOREIGN PATENT DOCUMENTS

DE 10128024 B4 7/2006
DE 202005012027 U1 11/2006
(Continued)

OTHER PUBLICATIONS

International Search Report dated Jun. 22, 2017 for PCT application No. PCT/EP2017/056579.
(Continued)

*Primary Examiner* — Joel M Attey
*Assistant Examiner* — Yeong Juen Thong
(74) *Attorney, Agent, or Firm* — Ohlandt, Greeley, Ruggiero and Perle, LLP

(57) ABSTRACT

A method for detecting a cleaning need of a commercial cooking appliance with at least one cooking surface. The method includes the steps of capturing at least one image of at least a part of the cooking surface and/or at least a part of a cooking product, comparing the captured image of the part of the cooking surface with a prestored reference image of a contaminated cooking surface requiring cleaning and/or of the captured image of the part of the cooking product with a prestored reference image of the cooking product in a cooking status indicating a need for cleaning the cooking surface, and deciding, based on the result of the comparison, whether a cleaning is needed. A further aspect relates to a
(Continued)

quality management monitoring system as well as a commercial appliance with a quality management monitoring system.

12 Claims, 4 Drawing Sheets

(51) Int. Cl.
*F27D 21/02* (2006.01)
*F27D 25/00* (2010.01)

(58) Field of Classification Search
CPC ..... H05B 6/64; H05B 6/6435; H05B 6/6414; H05B 6/642; A47J 36/32; A47J 27/16; A47J 2202/00; A47J 36/00; A47J 27/002; A47J 36/321; A47J 27/62; H04N 7/18; G01J 1/00; G06K 9/00; A01K 43/00
USPC ..... 219/393, 202, 390, 411, 707; 99/325, 99/342, 486; 703/2; 348/143, 7.085, 348/169; 356/121; 382/110; 250/458.1, 250/461.2, 339.09; 435/34; 426/233, 426/523, 231; 73/23.2
See application file for complete search history.

(56) References Cited

U.S. PATENT DOCUMENTS

2005/0057652 A1* 3/2005 Tagawa ..... H04N 21/4334 348/154
2010/0134620 A1* 6/2010 Bielstein ..... H04N 7/188 348/143
2010/0328450 A1* 12/2010 Wagner ..... D06F 34/18 348/135
2011/0134413 A1* 6/2011 Has ..... F24C 15/2021 356/51
2012/0075464 A1* 3/2012 Derenne ..... A61B 5/112 348/135
2013/0185079 A1 7/2013 Park et al.
2013/0197885 A1* 8/2013 Ahn ..... B22D 1/00 703/2
2015/0257596 A1* 9/2015 Vartanian ..... F21V 33/008 99/325
2016/0169744 A1* 6/2016 Apaydin ..... F24C 7/087 250/338.1
2016/0263799 A1* 9/2016 Shiraishi ..... B29C 45/1753
2017/0115008 A1* 4/2017 Erbe ..... F24C 7/081

FOREIGN PATENT DOCUMENTS

EP 1956301 A1 8/2008
EP 2977683 A1 1/2016

OTHER PUBLICATIONS

German Search Report dated Nov. 11, 2016 for German application No. 10 2016 206 483.5.

* cited by examiner

DYNAMIC QUALITY MANAGEMENT/MONITORING SYSTEM OF A COMMERCIAL COOKING APPLIANCE

BACKGROUND

1. Field of the Disclosure

The present disclosure relates to a method for detecting a cleaning need of a commercial cooking appliance as well as a quality management monitoring system of such a cooking appliance, in particular a dynamical quality management monitoring system. A further aspect of the disclosure relates to the cooking appliance itself.

2. Discussion of the Background Art

Commercial cooking appliances are cooking appliances used for commercial purposes. For example, grills, continuous ovens, combi steamers, fryers, kettles, cooking vessels, baking ovens and microwave ovens pertain to them.

During the operation commercial cooking appliances are contaminated due to their frequent usage. Depending on the kind of cooking and of the cooking products to be cooked, different contamination types and contamination degrees are to be expected within different time periods. Thus, for example a commercial cooking appliance may be contaminated more and more often, if a high-fat cooking product such fried chickens or roast beefs compared to other cooking products such as cakes or bread is cooked. As a contamination of the cooking appliance with regard to the quality of the cooking product, its safety for the human consumption and the efficient operation of the cooking appliance is crucial, the contamination has to be recognized and recorded so that the cooking appliance and its accessory may be cleaned.

With commercial cooking appliances such as for example hot air steamers, the provision of automatic cleaning systems for cleaning the cooking chamber of cooking appliances is common. Such cleaning systems are described in EP 1 473 521 A1, EP 1 717 518 A1 and EP 1 953 458 A1.

With a present cleaning system the cooking processes since the last cleaning cycle are taken into account, wherein the cleaning system may propose a cleaning sequence based on a determined contamination degree. Another existing cleaning system provides an environment-friendly option allowing: (a) skipping a drying step after the cleaning, (b) skipping a rinsing step or (c) reducing the consumed water quantity.

Furthermore, from EP 1 953 457 A1 another cleaning system is known. Hereto, an automatic cleaning method for removing contaminations, lime and/or corrosion based on a contamination degree is disclosed. In doing so, the contamination degree is determined by means of a turbidity sensor. After the determination of the contamination degree a number of cleaning points, that is to say cleaning times, is determined for repeated cleaning cycles defined each by a first time T1 and a second time T2. Furthermore, in EP 1 954 457 A1 the aspect of determining a cleaning, sequence based on time values, temperature values and values of a mechanical as well as a chemical action is generally discussed.

Further, a method and an apparatus for providing a flexible cleaning sequence for cooking appliances is known. Thereby, the operator of the cooking appliance may vary the parameters of a cleaning program such that the cleaning of the cooking appliance may be adapted to the contamination conditions of the cooking appliance and the cleaning program may be selected with regard to water, energy and cleaning agent savings.

However, with all these cleaning systems and cleaning methods a cleaning need is determined based on the operation times and/or operation modes (cooking programs) of the cooking appliance. Insofar, these systems and methods do not provide a dynamical determination opportunity of the contamination status of the cooking appliance or the quality of the cooking products to be cooked or cooked, on the base of which the cooking appliance is switched off.

Furthermore, from the state of the art different cooking appliances are known, with which the cooking product to be cooked may be identified. These cooking appliances normally include a cooking product acquisition device, for example a camera. Generally, the camera is positioned outside the cooking appliance such that a cooking product to be positioned into the cooking appliance is in the field of view of the camera. These appliances may additionally automatically provide cooking programs for the identified cooking products.

The cleaning systems and methods described above have some disadvantages. Most of these systems and methods are based on an observation by the operator or an indirect acquisition of the cleaning degree by means of a sensor to determine a cleaning need of the cooking appliance and to select a cleaning program for performing the cleaning. Insofar, in the determination of a cleaning need errors may occur. In particular, thereby no proper cleaning of the cooking appliance is ensured. It is also possible that the cooking appliance is operated further, though a cleaning of the cooking appliance should take place instead. The result is a degradation of the quality of the cooking product, wherein the appearance of the cooking product is unattractive in the best case and the cooking product is not suitable for human consumption in the worst case. This may result in dissatisfied customers and/or a waste of cooking products, causing a loss of profits. Furthermore, the described cleaning systems and methods are not capable of anticipating a cleaning need in a next cooking process.

Therefore, an object of the present disclosure is to propose a method for detecting a cleaning need of a commercial cooking appliance, wherein an objective and current determination of a cleaning need of the cooking appliance may be enabled.

SUMMARY

Specifically, the solution of this object is achieved by a method for detecting a cleaning, need of cooking appliance with at least one cooking surface, comprising the steps of capturing at least one image of at least a part of the cooking surface and/or at least a part of a cooking product, comparing the captured image of the part of the cooking surface with a prestored reference image of a contaminated cooking surface requiring a cleaning and/or of the captured image of the part of the cooking product with a prestored reference image of the cooking product in a cooked state indicating a need for cleaning the cooking sur face, and, based on the result of the comparison, deciding, whether a cleaning is needed.

The method according to the disclosure provides the advantage that a cleaning need of the cooking surface of the cooking appliance is determined by the current contamination status of the cooking surface. Therewith, it can be decided whether a cleaning of the cooking surface is needed in fact. Insofar, a cleaning only induced by the fact that a determined number of cooking processes has taken place and/or a determined operating time of the cooking appliance is reached may be avoided. This leads to a more efficient operation of the cooking appliance and substantial water, energy and cleaning agent savings.

Additionally, the determination of the cleaning need of the cooking surface or the timing for the required cleaning is not depending on the subjective judgment of the operator of the cooking appliance. In contrast to this, it may take place reliably and in real time. Thus, a high quality of the cooked cooking products is ensured.

Therefore, the determination of the cleaning need based on the contamination status of the cooking surface of the cooking appliance is firstly performed by observing this cooking surface. For example, a cooking surface may be one or more walls of the cooking chamber, an inner surface of a door for enabling or closing an access to the cooking chamber, the roast plates of a grill or the surface of a conveyor belt of a continuous oven. Alternatively or additionally, the cleaning need of the cooking surface may be gathered by observing a cooking product to be cooked or cooked or rather at last a surface of the cooking product to be cooked or cooked.

The contamination status or rather the cleaning need of the cooking surface is determined by means of the comparison of the captured image of the cooking surface and/or of the cooking product with prestored reference images. Based on this comparison it may be decided whether a cleaning of the cooking surface is required. Subsequently, appropriate cleaning methods may preferably be proposed or preselected.

For example, in case of coking the cooking surface coking particles released by the burning of fat may deposit on the cooking product. Thus, the captured image of the cooking product may indicate a contamination of the cooking surface.

Furthermore, it is an object of the present disclosure to provide a quality management monitoring system of a commercial cooking appliance as well as a cooking appliance, wherein an objective determination of a cleaning need of the cooking appliance may be ensured.

The solution of this object is achieved by the features of claims 10 and 11, respectively.

Specifically, the solution of this object is achieved by a quality management monitoring system of a commercial appliance with at least one cooking surface comprising an optical recognition device directed to at least a part of the cooking surface and/or to at least a part of a conking product to be cooked or cooked, and a control device being in signal connection with the optical recognition device. The control device here comprises a first memory for images, captured by the optical recognition device, of the part of the cooking surface and/or the part of the cooking product, a second memory for reference images of a contaminated cooking surface requiring a cleaning and/or for reference images of cooking products in a cooking status indicating a need for cleaning, and a comparator. A comparator is provided in signal connection with the first memory and the second memory for comparing the captured images with the reference images.

Furthermore, the solution of the mentioned object is a commercial cooking appliance with at least one cooking surface and the described quality management monitoring system.

The sub-claims provide advantageous developments of the present disclosure.

Preferably, a current cooking process may preferably automatically be interrupted or rather the cooking appliance may be switched off if a cleaning need of the cooking surface is detected. By means of the automatic interruption of the cooking process or rather the automatic switching off of the cooking appliance it may be avoided that the quality of the cooking product is degraded, even if the operator of the cooking appliance is occupied by other activities A permanent monitoring of the cooking appliance by the operator is thus not required.

Preferably, a remaining cooking time till the completion of the current cooking process is compared with a predetermined time threshold. Thereby, the cooking appliance is switched off only after the expiration of the remaining cooking time if the remaining cooking time is less than the predetermined time threshold. Thus, cooking processes in which the remaining cooking time is less than the predetermined time threshold may be finished firstly, before the cooking appliance is switched off. In such cases where a cooking cycle or rather a cooking program is nearly completed, an interruption of the cooking process or rather a switching off of the cooking appliance directly after the determination of the cleaning need would in total result in a small advantage for the operation of the cooking appliance or rather no noticeable impairment of the cooking product.

Advantageously, a current contamination degree is calculated and/or a current contamination type is determined based on the captured image of the cooking surface and/or the cooking product. Thus, a quantitative determination of the contamination status of the cooking surface is achieved. Thereby, a contamination status or rather a cleaning need of the cooking surface may be determined by the comparison of the current contamination type of the cooking surface with preset or known values. In calculating the current contamination degree, the captured contamination type is preferably taken into consideration.

According to a preferred configuration of the present disclosure, a cleaning need is determined with a next cooking process. Thereby, the contamination degree of the cooking surface of the cooking appliance may preferably be acquired and be compared with the next anticipated cooking process. In case that it is likely in the next anticipated cooking program or rather cycle that the determined contamination degree of the cooking surface exceeds an acceptable predetermined contamination degree and/or an acceptable predetermined quality level of the cooking product, a cleaning of the cooking appliance may be proposed or demanded prior to the start of the next anticipated cooking program or rather cycle. Thus, the method has an anticipating or rather forecasting aspect.

It is in particular preferred that a contamination degree and/or contamination type of the cooking surface to be expected in a next cooking process is determined based on the current contamination degree and/or contamination type of the cooking surface and/or a remaining cooking time till the completion of the current cooking process and/or a cooking time of the next cooking process. Thereby, it is preferably proposed or demanded that the cooking surface is cleaned prior to the start of the next cooking process, if the contamination degree to be expected requires a cleaning of the cooking surface. This is particularly advantageous, if there is no cleaning need with the current contamination degree. Thus, it may be predetermined whether a cleaning need will be likely in the next cooking process.

In such a case the cooking appliance may advantageously be switched off after the completion of the current cooking process.

For cleaning the cooking surface, preferably a cleaning program is selected from prestored cleaning programs based on the current and/or expected contamination degree and/or the current and/or expected contamination type. Based on the determined contamination degree, the quality management monitoring system may propose any number at cleaning processes. These include, for example, a simple brush cleaning, a hand cleaning with any cleaning agent, an automatic cleaning cycle using washing agents or descaling agents and so on. Additionally, the quality management monitoring system may interrupt the operation of the cooking appliance to ensure optimal cooking results and to avoid potential health problems and/or damaging of the cooking appliance.

Preferably, a warning signal is output if a cleaning need of the cooking surface is detected. Here, the cleaning need may be a cleaning need in a current and/or a next cooking process. Thus, an operator of the cooking appliance may be indicated that a cleaning of the cooking appliance is needed and/or that a next cooking program or rather a next cooking cycle should not start. The warning signal may here preferably be an alert, a blinking light, a message at a user interface such as a display or another part or the cooking appliance or a vibration in a wireless or portable apparatus or similar types of signaling which point out that the cooking appliance has to be cleaned and/or its operation has to be interrupted till the cooking appliance is cleaned.

In case of determining that the quality of the cooking product or the cooking surface of the cooking appliance is substandard, for example in case of an excessive tanning, an excessive number of speckles on the surface of the cooking product or an excessive fat formation on the cooking surface of the cooking appliance or in the cooking chamber, a warning signal is output preferably.

According to a preferred configuration of the present disclosure, the output warning signal and/or a turned-off status of the cooking appliance and/or an interrupted status of the cooking process may be overwritten and/or overrided, if an operator of the cooking appliance is again switching on the appliance.

Advantageously, images of the cooking surface and/or the cooking product are captured continuously or in predetermined time intervals. Thus, the determination of a cleaning need of the cooking surface is performed dynamically by analyzing the cooking product and/or the cooking surface of the cooking appliance during the cooking process in order to decide whether a cleaning is necessary.

In doing so, the optical recognition device is particularly preferably configured in a digital manner.

For capturing images, the optical recognition device is preferably provided with a digital image capturing element, in particular an electronic image sensor. Here, the electronic image sensor may be configured as a CCD sensor or CMOS sensor.

In a particularly preferred manner, the optical recognition device is configured such that the acquired image data are in a digital format from the beginning. This is the easiest way to evaluate, analyze, manipulate and/or process the image data. The image data may here be stored in a data memory. Furthermore, in a simple way it may be possible to access the image data from the data memory. Alternatively, the image data may be stored in the control device of the quality management monitoring system. In doing so, it is possible to access the image data directly.

According to an alternative configuration of the present disclosure, the image data may be present in a non-digital, for example analogue, format. In this case the image data is converted into a digital form. For example, colors may firstly be calculated in grey tones to which digital values have been associated to previously, and then be analyzed digitally.

The digital optical recognition device preferably comprises an optical device and a device for electronically evaluating the objects observed or rather captured by the optical device. Further, the digital optical recognition device preferably includes a device for recognizing a surface of the cooking product to be cooked or cooked and/or a cooking surface of the cooking appliance. In particular, within the scope of the disclosure any surface being an integral part of the cooking appliance is to be understood as a cooking surface of the cooking appliance. Here, the cooking surface of the cooking appliance may include an inner wall of the cooking chamber, an inner door surface, a grill surface, a conveyor belt or the inner walls of a continuous oven, the walls of cooking vessels or kettles, the external edges and/or inner surfaces of a fryer and/or a surface of any component of the cooking appliance.

According to a preferred configuration of the present disclosure, the quality management monitoring system includes a digital optical recognition device directed to the surfaces of the cooking product to be cooked and/or cooked and/or of the cooking appliance and observing them, a control device for operating the cooking program or rather the cooking cycle of the cooking appliance and the quality management monitoring system, and a collection of images of the surfaces of the cooking product to be cooked and/or cooked and/or of the surfaces of the cooking appliance, being stored in the control device or in another storage medium. The optical recognition device may preferably be arranged and configured in or on the cooking chamber of the cooking appliance or close to the cooking appliance in order to capture images of the cooking product to be cooked or the cooked cooking product, while the cooked cooking product leaves the cooking chamber of the cooking appliance. Alternatively or additionally, the optical recognition device is configured to capture images of a surface or a number of selected surfaces of the interior of the cooking appliance or other surfaces of the cooking appliance. Preferably, the images may be captured either continuously or in predetermined time intervals. In addition, the quality management monitoring system may preferably output a command or an instruction so that the monitoring system is switched off and the current cooking cycle or rather the current cooking program can be finished.

Also the quality management monitoring system may preferably include an integrated delay time for the command described above or rather the instruction described above for switching off the monitoring device, thereby also realizing, besides the determination of a cleaning need of the cooking appliance, that a cooking program or rather cycle has a limited remaining runtime till the completion of the cooking program or rather the cooking cycle so that the cleaning can take place only after the completion of the cooking program or rather the cooking cycle.

Moreover, the quality management monitoring system may preferably have an anticipating or rather forecasting aspect such that the quality management monitoring system gathers the contamination degree of the cooking appliance and compares the determined contamination degree with the next anticipated cooking process. If it is likely in a next anticipated cooking program or rather cooking cycle that the contamination degree of the cooking appliance exceeds the acceptable contamination degrees and/or the acceptable quality level of the cooking product, the quality management monitoring system may preferably propose or demand a cleaning of the cooking appliance prior to the start of the next expected cooking program or rather cooking cycle. Advantageously, the quality management monitoring system has a warning indicator to indicate an operator of the cooking appliance that a cleaning of the cooking appliance is necessary and/or that a cooking program or rather a cooking cycle has been completed and/or should not start. Preferably, the quality management monitoring system includes stored cleaning programs the application of which may depend on the contamination degree and/or the contamination type of the cooking appliance. Thus, the quality management monitoring system may be configured to propose a specific cleaning program and/or cleaning agent based on the determined contamination degree and/or the contamination type.

The quality management monitoring system and the method for determining a cleaning need of the cooking appliance may preferably be overwritten by the operator of the cocking appliance manually by switching on the cooking appliance by the operator after the cooking appliance was switched off if the quality of the cooking product to be cooked or cooked according to the standard quality criteria indicates a cleaning need in the comparison with the reference images and/or if it is determined that the cooking surface is contaminated to that extent that a cleaning is needed. In completing the next cooking process after the overwriting, the operation of the cooking appliance is automatically interrupted till the cooking appliance is cleaned.

The optical recognition device, in particular the digital optical recognition device, itself or in a status mounted in a housing is preferably formed and/or configured in an adjustable manner in order to move or rotate during the operation in order that images of the cooking product and/or the cooking surfaces of the cooking appliance may be captured from different viewing directions or perspectives. For this purpose, a programmable control unit may be provided which is configured to move the digital optical recognition device in coordinated manner synchronized with the cooking programs or cooking recipes. The programmable control unit may preferably be the control device of a quality management monitoring system.

Advantageously, in the quality management monitoring system real-time information at first hand on the contamination status of the surface of the cooking product to be cooked or cooked and/or the cooking surface of the cooking appliance and/or the inner environment of the cooking appliance for determining a cleaning need of the cooking surface or rather the inner environment of the cooking appliance is used so that the quality of the cooking products cooked or to be cooked is maintained.

Within the scope of the present disclosure, the term "image" may be understood as an individual image or a sequence of images such as a video.

The optical recognition device is arranged in signal connection with a control device having access to image data, that is to say image or video recordings of surfaces of the cooking product to be cooked or cooked and/or cooking surfaces of the cooking appliance. Thereby, the control device may preferably be formed as a part of the optical recognition device. In addition, the control device may preferably also have additional functions. The control device has access to the image data, i.e. the digital data, the images of the surfaces of the cooking product to be cooked or cooked and/or the cooking chamber or everything being calculated from the captured images of the surfaces of the cooking product to be cooked or cooked and/or the cooking surface of the interior or other surfaces of the cooking appliance or components of the cooking appliance such as for example a conveyor belt of the continuous oven. Alternatively, an analogue optical recognition device may also be used.

The optical recognition device may preferably be arranged in or at the cooking chamber or at other surfaces of the cooking appliance or its components. Preferably, the optical recognition device is configured such that all cooking products to be cooked or cooked and/or at least those cooking surfaces being contaminated most likely are in a field of view of the optical recognition device.

The cooking surfaces normally being contaminated in different cooking appliances are the inner walls and/or an inner door surface of the cooking appliance, a grill surface, the inner walls or a conveyor belt of a continuous oven, an inner fryer pot of a fryer or the inner walls of cooking vessels or kettles.

According to its position in, at or in the vicinity of the cooking appliance, the optical recognition device has a reliable view to each cooking product to be cooked or cooked in the cooking appliance. For all cases where the same or similar cooking products are cooked in the cooking appliance, an individual optical recognition device is preferably provided at the quality management monitoring system and/or the commercial cooking appliance. This is particularly advantageous in cases where the same or similar cooking products are cooked in an intermittent cooking process or rather a batch process. Also in cases where the cooking products are cooked in a continuous process, an individual optical recognition device may preferably be used as well. However, as in continuous cooking processes the cooking products are normally put into the cooking appliance and removed from the cooking appliance at different times, a plurality of optical recognition devices may preferably be provided. Thus, the different cooking products may be observed simultaneously, particularly each by a discrete optical recognition device.

In a continuous cooking process however, it is more efficient and easier if only the cooking surface of the cooking appliance is observed by the optical recognition device so that particularly only the contamination degree of the cooking surface is determined. The reason for this is that in a continuous cooking process the cooking products being present in the cooking appliance change permanently leading to the fact that the different surfaces of the cooking products being observed by the optical recognition device do not remain constant.

The features described above relating to the optical recognition device apply to each optical recognition device if more than one optical recognition device is provided at the quality management monitoring system and/or the cooking appliance.

Preferably, the commercial cooking appliance may be configured as a combi steamer. A combi steamer is a cooking appliance serving for cooking by means of hot air, steam or hot steam or combinations of this cooking methods. Thereby, the combi steamer preferably includes at least one cooking, chamber, a door configured to be opened and closed in order to enable or block an access to the cooking chamber, a steam generator, a fan, a heating element for heating the cooking chamber and a control device with a user interface. The user interface may include a display.

Other commercial cooking appliances in which the quality management monitoring system according to the disclosure may be used and with which the method according to the disclosure may be applied are hot air steamer, continuous ovens, foldable grills, cooking vessels, fryers, kettles, baking ovens, microwave ovens or hot-air ovens. Each of these cooking appliances has at least one cooking surface prone to be contaminated, whereby the quality of the cooking products to be cooked or cooked may be degraded.

For example, with a hot-air steamer including a cooking chamber configured as a cavity a ceiling wall, a bottom wall, sidewalls as well as an inner door surface will be contaminated. The contamination may here include for example a tanning and/or a greying and/or a blackening of these surfaces. Different tanning degrees may indicate a protein and/or fat contamination of different degrees of severity. Different greying degrees may indicate the formation of a salt crust and/or lime depositions on components of the cooking appliance. The usage of a smoke generator may be recognized by means of different blackening degrees. Based on the determined contamination degree and/or contamination type of the cooking surfaces, the most effective and most efficient automated cleaning method may be proposed.

With a foldable grill, normally the grill surface will be contaminated and/or become sticky. An increase of the number of dark speckles, black pigments or depositions on the grill surfaces leaves unsightly stains on the cooking products indicating an accumulation of dirt and/or non-desired depositions on the grill surfaces.

With a cooking appliance configured as a continuous oven, the inner walls of the continuous oven or the conveyor belt will be contaminated with fats which may fall on or into the cooking products to be cooked. Thereby, the appearance and the taste of the cooking products are impaired. Furthermore, an inflammation may be caused in the interior of the continuous oven. This may not only burn the cooking product, but also damage the cooking appliance itself.

Based on determined contamination degree, the quality management monitoring system may propose any number of cleaning processes. These include, for example, a simple brush cleaning, a hand cleaning with any cleaning agent, an automated cleaning cycle using washing or descaling agents and so on. Additionally, the quality management monitoring system may interrupt the operation of the cooking appliance to ensure optimal cooking results and to avoid potential health problems and/or damaging of the cooking appliance.

The cooking appliance may have preset quality parameters which can be recognized by the quality management monitoring system and/or an installed program, wherein the installed program is executed in connection with the quality management monitoring system and/or for controlling the quality management monitoring system. The quality management monitoring system and/or the program may further enable a modification of the preset parameters by the operator of the cooking appliance in order to set modified or new parameters and/or to add new images or parameters and/or to overwrite the preset parameters or rather the operation of the quality management monitoring system so that the cooking program or rather the cooking cycle will be interrupted if the acquired contamination status or the acquired quality of the cooking product meet the preset, modified on new parameters. The overwriting of the preset parameters or rather overriding the operation of the quality management monitoring systems may be desirable in those cases where the cooking process is nearly completed, for example if only one minute cooking time remains. In such cases an interruption of the cooking cycle or rather the cooking program would in total result in a small advantage for the operation of the cooking appliance or rather no noticeable degradation of the quality of the cooking products. Furthermore, the possibility of overwriting the preset parameters or rather overriding the operation of the quality management monitoring system would be useful in those cases where the operator of the cooking appliance decides upon the continuation of the operation of the cooking appliance regardless of the determined cleaning need. Here, the operator can manually override the stopped status of the cooking appliance.

It should be noted that all features, functions and advantages described above relate to both of the method and the duality management monitoring system or rather the cooking appliance according to the present disclosure.

BRIEF DESCRIPTION OF THE DRAWINGS

Further details, advantages and features of the present disclosure result from the following description of a preferred embodiment by means of the drawing. Therein.

DETAILED DESCRIPTION OF THE PREFERRED EMBODIMENT

Figure 1:
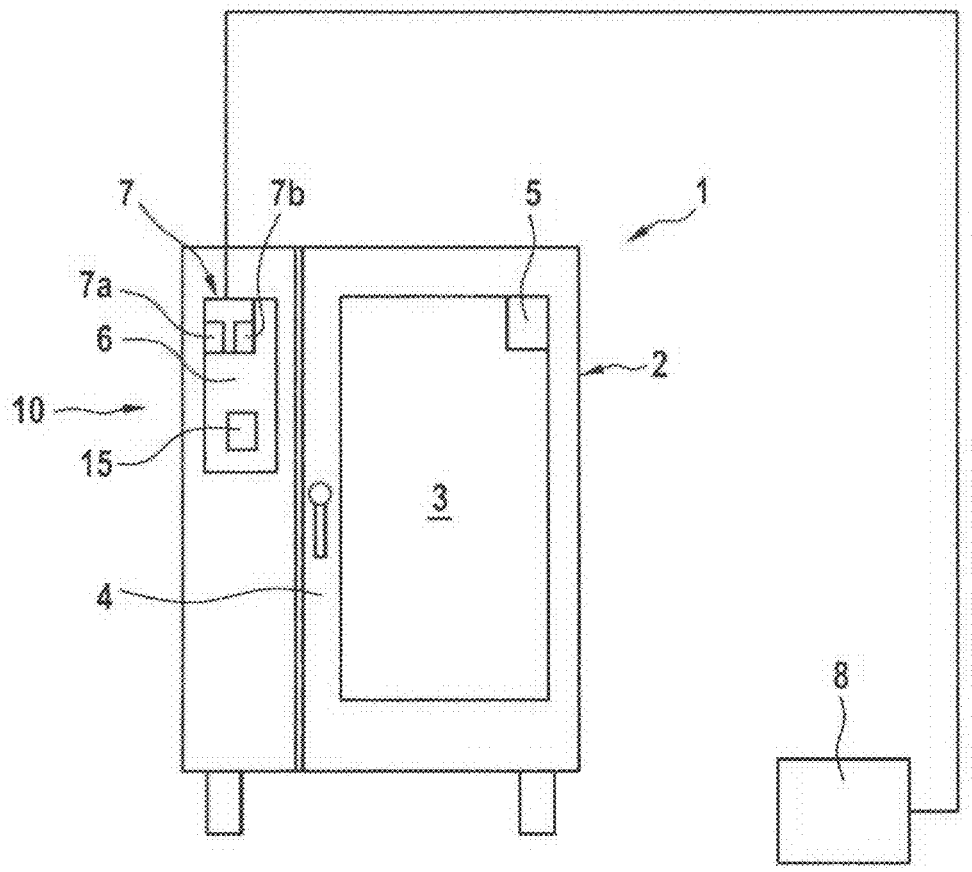
FIG. 1 shows a highly simplified schematic front view of a cooking appliance with a quality management monitoring system according to preferred embodiment of the present disclosure.

FIG. 1 shows a front view of a schematically simplified representation of a commercial cooking appliance 1 according to a preferred embodiment of the disclosure in which a quality management monitoring system 10 is used. Preferably, the cooking appliance 1 is a combi steamer. Alternatively, the cooking appliance 1 may be a baking oven, a microwave oven, a grill, a fryer or a cooking vessel. The quality management monitoring system 10 is particularly configured as a dynamic optical quality management monitoring system 10 (DOQM system).

Preferably, the cooking appliance 1 includes a housing 2 with a cooking chamber 3. The access to the cooking chamber 3 is provided by a door 4 configured to be opened and closed. The cooking appliance 1 further includes an optical recognition device 5 particularly configured as a digital optical recognition device (DORD system).

From FIG. 1 it can be seen that the optical recognition device 5 is preferably positioned within the cooking chamber 3 at or near to an upper area of a cooking appliance 1. However, the optical recognition device 5 may arbitrarily be arranged in, on or near to the cooking chamber 3 as long as a clear view to at least one cocking surface or one cooking product to be cooked or cooked by the optical recognition device 5 is guaranteed. Furthermore, the cooking appliance 1 includes an user interface 6. In FIG. 1 the cooking appliance 1 is shown with one single digital optical recognition device 5. Alternatively, a number of optical recognition devices 5 may be provided. Also, the cooking appliance 1 has a control device 7 which is in signal connection with the user interface 6 as schematically shown in FIG. 1. It should be noted that in this embodiment the control device 7 is arranged within the cooking appliance 1, wherein the control device 7 is invisible from outside.

During a cooking process of the cooking appliance 1 the optical recognition device 5 is preferably configured to capture one or more images of the cooking product to be cooked or cooked and/or of a cooking surface of the cooking chamber 3 continuously. Alternatively, the capture of images may take place in time intervals.

It is to be expected that the surfaces of which images are captured may change during a cooking program or rather a cooking cycle. Therefore, the optical recognition device 5 is further configured to be rotated and/or adjusted automatically. Thus, for example during the cooking process images of different surfaces of the cooking product or cooking surfaces of the cooking appliance 1 may alternately be captured. The captured images will then be compared with reference images of the cooking product indicating a cleaning need of the cooking surfaces and/or reference images of contaminated cooking surfaces requiring a cleaning. The captured images may preferably be stored in a first memory 7*a* of the control device 7 and the references images in a second memory 7*b* of the control device 7. Alternatively or additionally, the captured images and/or the reference images may be stored in a separate storage device or rather in a separate memory being in a signal connection with the control device 7.

With the beginning of a cooking, program or rather a cycle the optical recognition device 5 is activated. This may take place for example either automatically by switching on the cooking appliance 1 or by the control device 7. The optical recognition device 5 starts to capture images of the cooking product and/or of one or more cooking surfaces of the cooking chamber 3. Data information which may be extracted from the captured images and serve for dynamically determining a contamination degree of the cooking surface(s) of the cooking chamber 3 may also be stored in the first memory 7*a* of the control device 7 or in the separate memory 8. Preferably, the optical recognition device 5 is for example arranged at a guide rail or a similar device. Here, the optical recognition device 5 is configured to move upwards and downwards inside the cooking chamber 3. Thus, the optical recognition device 5 may capture images of different surfaces of the same cooking product and/or of different cooking products. This may particularly be advantageous if different cooking products are simultaneously cooked in a continuous/ongoing cooking process ("rolling"-type cooking process). In addition, the optical recognition device 5 may preferably be configured to move along the guide rail or the similar structure in order to position itself next to the respective cooking product. A movability of the optical recognition device 5 within the cooking chamber 3 is particularly advantageous in cooking appliances with plural cooking levels on which the same or different cooking products may be cooked.

Furthermore, the cooking appliance 1 may be provided with an illuminating device configured to illuminate the cooking product to be cooked or cooked and/or cooking surface of the cooking chamber 3 while capturing images. For example, the optical recognition device 5 is an optical device with a main lens, wherein the main lens preferably has a small aperture so that a high depth of focus is provided.

Below, a method according to the embodiment of the present disclosure described in detail with reference to FIGS. 2A and 2B.

Figure 2A:
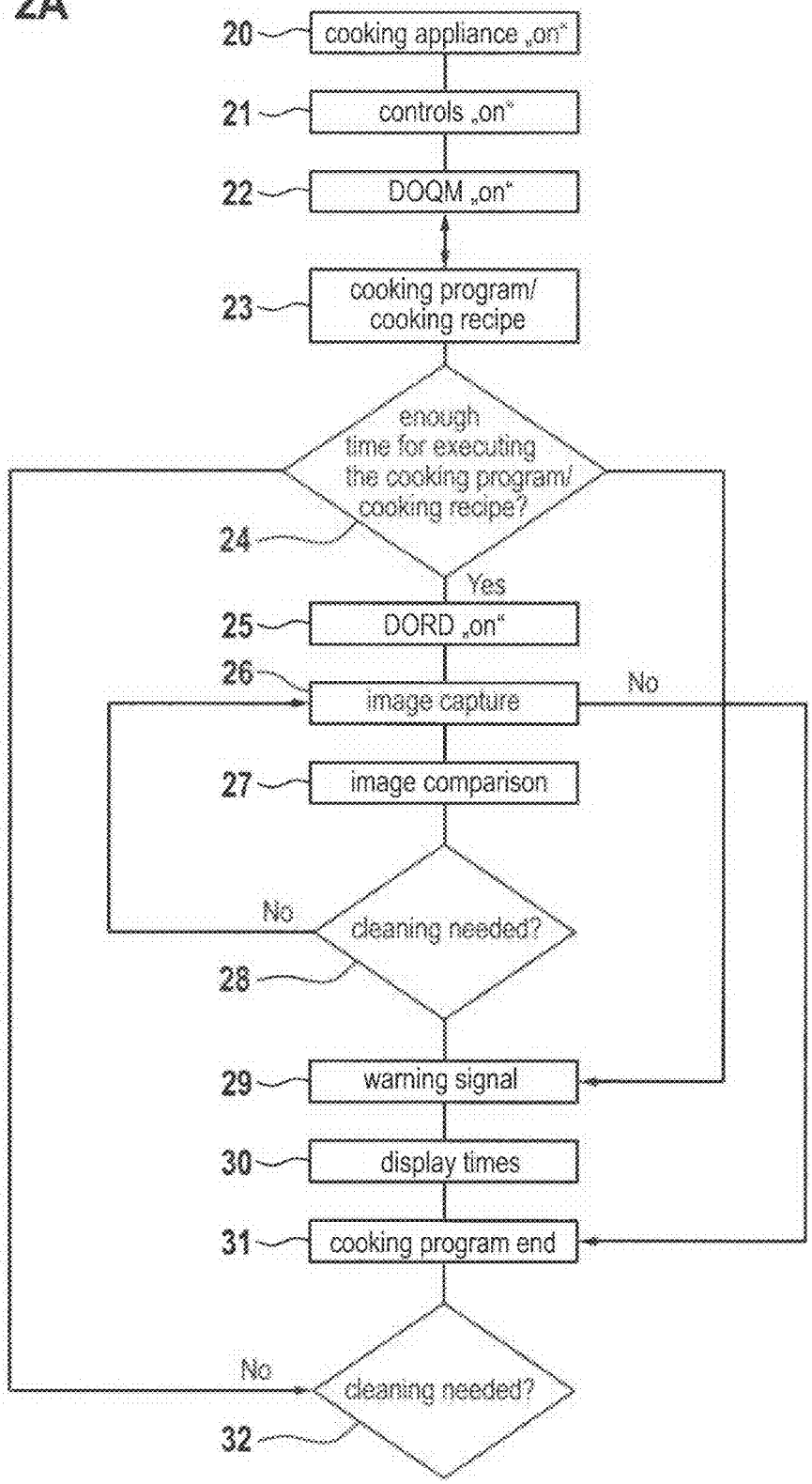
FIGS. 2A, B show a flow diagram of a process of a quality management monitoring system by means of which the method according to the preferred embodiment is explained.

In FIG. 2A interactions of an operator of the cooking appliance 1 and the quality management monitoring system 10 with the cooking appliance 1 are shown. Generally, the method comprises the following steps.

In step 20, the cooking appliance 1 is switched on by the operator. After switching on the cooking appliance 1. In step 21, the controls of the cooking appliance 1 are also switched on. In step 22, the quality management monitoring system is activated. The steps 21 and 22 may either be automatically be executed as a result of step 20 or be separate actions being performed manually by the operator of the cooking appliance 1. In order to avoid potential mistakes and to reduce the number of steps to be performed by the operator, steps 21 and 22 are automatically executed as a result of step 20. In step 23, a cooking program or a cooking recipe is input either automatically or manually. With the input of the cooking or the cooking recipe, preferably the quality management monitoring system is provided with inter alia information on the type of the cooking program as well as details such as for example temperature, cooking time, regulation of steam times, pause times or end times of the cooking program. This is indicated by the double arrow between steps 22 and 23. The term "type" of the cooking program means whether it is a continuous/ongoing cooking program ("rolling"-type cooking program) or a discontinuous cooking program or rather a batch program ("batch"-type cooking program).

In step 24, a decision point or rather decision block is reached. Here, it is questioned whether there is enough time to execute the input cooking program or cooking recipe before a cleaning of the cooking appliance is needed. If the answer to this question is "No", the method proceeds to step 29, and a warning signal is output. In case of answer "Yes", the cooking program is started, and the method proceeds to step 25. However, the step 24 is optional. This means that the step 24 is either not existing or may be cancelled. In this case, the quality management monitoring system is forwarded to step 25.

In step 25, the optical recognition device 5 is activated. After the activation of the optical recognition device 5 preferably occurring automatically, the image sharpness of the optical recognition device 5 is adjusted. This is realized particularly in an automatic manner, for example by the control device 7 or an autofocus. It should be noted that the optical recognition device 5 may be formed as an autofocus imaging device so that a change of the field of view of the optical recognition device 5 does substantially not change the quality of the captured images. The activation of the optical recognition device 5 in step 25 is advantageously performed by the quality management monitoring system. Depending on whether the cooking program is a continuous or discontinuous cooking program, the quality management monitoring system may instruct the optical recognition device 5 to capture images only from the cooking surfaces of the cooking appliance 1 or rather inner surfaces of the cooking chamber 3. It should be noted, that the determination of the type of the cooking program may be not provided in other cooking appliances.

In step 26, the optical recognition device 5 captures at least one image, preferably a plurality of images, of a surface of a cooking product to be cooked or cooked and/or a cooking surface of the cooking chamber 3 during the operation of the cooking program. The captured images are stored in the first memory 7*a* of the control device 7 or in the separate memory 8 being in signal connection with the cooking appliance 1 and electronically accessible through the control device 7.

In step 27, the images, captured in step 26, of the surface of the cooking product to be cooked or cooked are compared with reference images of the same or a similar cooking product to be cooked or cooked indicating a contamination of the cooking surface. Alternatively or additionally, the images, captured in step 26, of the cooking surface are compared with reference images of a contaminated cooking surface requiring a cleaning. In particular, thereby the captured images of the cooking surface are compared with the same cooking surface in a contaminated status required a cleaning.

It is particularly preferred that the images captured by the optical recognition device 5 in step 26 pass to the control device 7. Then, the control device 7 compares the captured images with a database of precaptured and prestored reference images residing in the first memory 7*a* of the control unit 7 or in the separate memory 8. The database of the previously captured reference images may be stored in the second memory 7*b* of the control device 7, in the separate memory 8 or in a memory integrated in the cooking appliance 1, but not necessarily in the control device 7.

Furthermore, the precaptured reference images may be selected from images of surfaces of precooked cooking products in the same cooking appliance 1, from a collection of images of precooked cooking products in other cooking appliances with the same or a similar equipment or from a pool of images of cooking products. Alternatively, data sets, particularly data sets of the manufacturer of the cooking appliance 1, may be loaded as reference images. The manufacturer may generate data sets by testing publicly available or special cooking products. For example, a fast food chain may send a special product being available or to be launched in the market soon to the manufacturer of the cooking appliance 1. Then, the manufacturer may generate images of the product in a laboratory. Alternatively, the operators of the cooking appliance or chefs may have their own cooking recipes or cooking programs with related images of cooking products to be cooked or cooked in their own databases.

In step 28, based on the comparison performed in step 27 a further decision point is reached at which it is questioned whether a cleaning is needed. If the answer to this question is "No", the method returns to step 26, and the steps 26 and 27 will be repeated till the cooking product is cooked and the cooking program comes to an end. If the answer to the question concerning, the cleaning need is "Yes", the method proceeds to step 29, and a warning signal is output. If in step 28 the answer is "Yes", the quality management monitoring system automatically deactivates the cooking appliance 1 so that no further cooking can take place till the cooking appliance 1 is cleaned. Optionally, the quality management monitoring system may determine a remaining cooking time till the completion of the current cooking process in step 28, wherein the cooking appliance may at first complete the current cooking process as long as there is no risk in operating the cooking appliance 1. After that the cooking appliance 1 may automatically be deactivated till the cooking appliance 1 is cleaned.

In step 29, furthermore the notification of a cleaning need of step 28 may be overrided by the operator of the cooking appliance 1. If the requirement of cleaning is overrided, this information may be stored as a reference (for example for a quality check or a training of operators) either in the control device 7 or the quality management monitoring system 10. The time of overriding the requirement of the cleaning is indicated in step 30. Alternatively or additionally, in step 30 a time till switching off may be shown, indicating time shift of performing a cleaning process. It should be recalled that in step 28 the quality management monitoring system may also determine the remaining cooking time of a cooking process. Insofar the time shown in step 30 may be the previously described time of overriding the requirement of the cleaning and/or the switch off time. In step 31, the cooking program 23 is completed. The steps 29 and 30 are optional.

Furthermore, it should be recalled that the steps 26 and 27 are repeated if no cleaning is needed in step 28. If a cooking program without a cleaning need ends, the method proceeds to step 31. In this case after the completion of the cooking program 23 according to the step 32 another decision point is reached where it is questioned whether a cleaning is needed. If the answer to this question is "No", the method returns to step 23. If step 24 is omitted or not existing, then the quality management monitoring system is routed to step 25. At this time, a new cooking program is input (step 23), and the control device 7 and/or the quality management monitoring system have access to: (1) the cooking time and other parameters concerning the new cooking program and (2) reference images or rather image data for comparison concerning the contamination degree of the cooking chamber 3 or the cooking product to be cooked or cooked. At this point the control device 7 and/or the quality management monitoring system determine whether there is enough time for completing the new cooking program before cleaning is required. Afterwards, the program according to the steps described before is continued. If the answer to the question in step 32 is "Yes", the method preferably continues according to FIG. 2B.

Figure 2B:
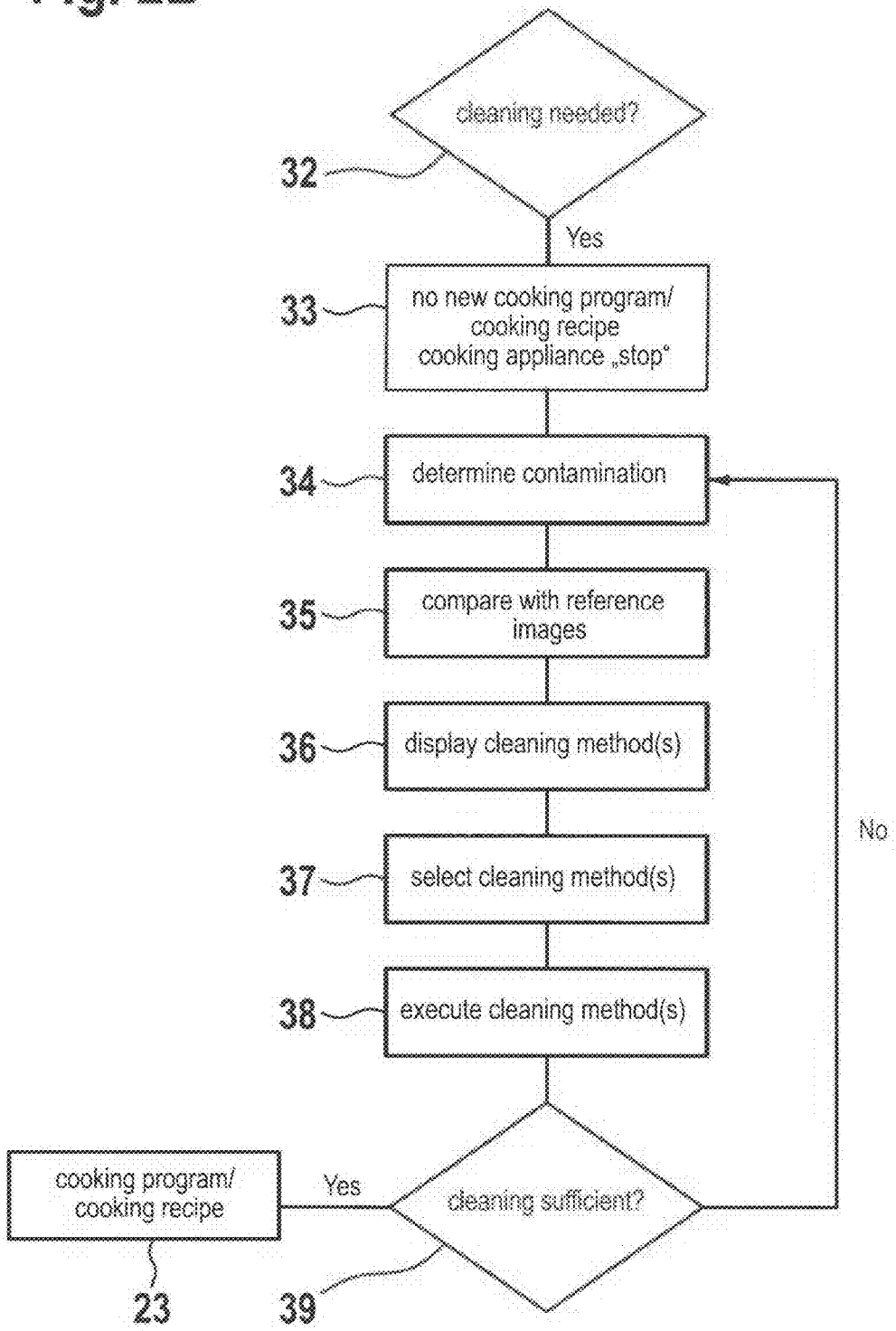

As can be seen from FIG. 2B, in case of a positive answer to the question in step 32 the method proceeds to step 33. In step 33, the input of a new cooking program or rather cooking recipe is prohibited, and the cooking appliance 1 is automatically stopped. At this point the method proceeds to step 34. In step 34, the contamination degree and the contamination type are determined. It should be recalled that reference images, showing different contamination degrees and/or contamination types, are prestored in the control device 7 and/or the separate memory 8.

In step 35, the contamination degree and/or contamination type determined in step 34 are compared with the reference images. Based on the result of the comparison, an appropriate cleaning method or a plurality of appropriate cleaning methods and/or cleaning products is determined. In step 36, the determined cleaning methods and/or cleaning products are displayed at the user interface 6.

In step 37, the indicated cleaning method or a selection of cleaning methods in case that a number of cleaning methods is indicated is selected. Alternatively, the operator of the cooking appliance 1 may input another cleaning method or change an already existing indicated cleaning method in step 37. In any case, each selected cleaning method is performed in step 38. Therefor, the cooking appliance 1 preferably has a cleaning device.

In step 39 representing another decision point, it is questioned whether the performed cleaning is sufficient. In case that the answer to this question is "Yes", the method proceeds to step 23 so that a new cooking program or cooking recipe may be input. If the answer to this question is "No" the method returns to step 34, and the steps 34 to 38 are repeated.

In the following, the quality management monitoring system 10 of the cooking appliance 1 is described in detail with reference to FIG. 3. The quality management monitoring system 10 is configured to execute the method described above.

Figure 3:
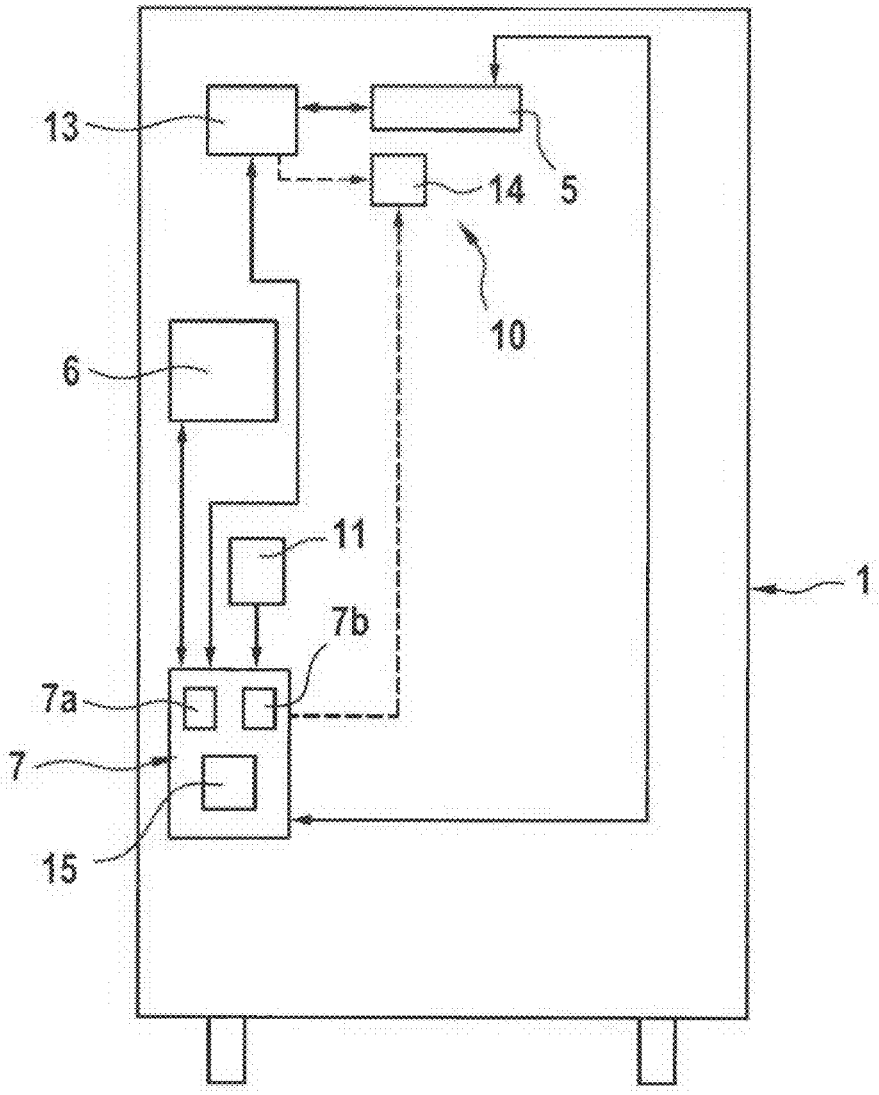
FIG. 3 shows a schematic representation of the quality management monitoring system of FIG. 1.

The cooking appliance 1 of FIG. 3 is provided with a main switch 11. For switching on the cooking appliance 1 the main switch 11 is activated whereby in turn the control device 7 is activated. The control device 7 controls all cooking functions and parameters of a cooking process such as the time and the temperature of a cooking program and the regulation of steam. Furthermore, the control device 7 may preferably activate the optical recognition device 5. However, the optical recognition device 5, as already described above, may manually be activated. The optical recognition device 5 is in signal connection with the control device 7 symbolized by the double arrow between the control device 7 and the optical recognition device 5 in FIG. 3. In addition, the optical recognition device 5 is configured to send information from the captured images to the control device 7. This information may be stored in the control device 7 or in the separate memory 6 (FIG. 1) or in a database of the cooking appliance 1 for different purposes, as described below.

From FIG. 3 it results that the cooking appliance 1 comprises a control 13 which is activated by the control device 7 for controlling the optical recognition device 5 and an illuminating device 14, if any. Alternatively, the control device 7 is configured to control the optical recognition device 5 and the illuminating device 14 directly.

Furthermore, the control device 7 has access to prestored reference images of different cooking products to be cooked or cooked indicating a contamination of the cooking surface(s) of the cooking appliance. By means of a comparator 15 of the control device 7 and/or the control 13 these reference images are compared with the images, captured by the optical recognition device 5, of the cooking products to be cooked or cooked. Under special circumstances, the control 13 also enables a continuation of the cooking program even if otherwise a warning would have been output or a deactivation of the cooking program would have been recommended.

Furthermore, the control 13 controls the output of a warning signal to the operator of the cooking appliance 1 that a new cooking product to be cooked should not be placed into the cooking chamber 3. The control 13 may be configured as a part of the control device 7. In any case, the control device 7 is configured to execute the functions described above. While images of a surface of the cooking product and/or a cooking surface of the cooking chamber 3 are captured by the optical recognition device 5, this information is forwarded to the control 13. This is symbolized by a double arrow between the control 13 and the optical recognition device 5.

The decisions of the control 13 concerning the output of a warning, the deactivation or the continuation of the cooking program or rather cooking cycle, the output of the warning, to place no new cooking product into the cooking chamber 3 are delivered to the control device 7 (indicated by the double arrow between the control 13 and the control device 7). The determinations performed by the control 13 are forwarded to the user interface 6 by the control device 7.

The user interface 6 includes, for example, a touch screen and/or a display for providing information to the operator and inputting information by the operator. The user interface 6 and the control device 7 are connected with each other in an interacting manner which is indicated by the double arrow between the user interface 6 and the control device 7. This interaction is advantageous in the case where for example the operator wants to overcome some aspects of the operation of the cooking appliance 1 such as the recognition of selected cooking products and/or whether the cooking program is incorrectly selected. In these cases the operator may select the cooking product and/or the cooking program. This information is then forwarded to the control device 7 so that the appropriate cooking program is selected.

As can be seen from the preceding description, the quality management monitoring system 10 and the corresponding method according to the present disclosure allow a continuous monitoring of a cooking process and offer the user a number of decision points where the user may input decisions/information while simultaneously enabling an automatic control of the cooking program. Since all information regarding the cooking programs and the decisions/information of the user are stored, the following may easily be determined: (1) the usage and the wear of the cooking appliance 1; (2) the type and the number of the cooked cooking products; and (3) errors during the method.

In addition to the above-mentioned written description of the disclosure, hereby supplementing the disclosure, explicit reference shall be made to the graphic representation of the disclosure in FIGS. 1 to 3.

The complete content of the patents, the patent publications and other references it has been referred to is made to a content of the disclosure of the present application by reference.

While the preferred embodiment of the present disclosure has been described using specific terms, the description serves for illustrating purposes, and it should be obvious that changes or modifications can be devised without departing from the scope of the claims appended hereto.

LIST OF REFERENCE SIGNS

1 commercial cooking appliance
2 housing
3 cooking chamber
4 door
5 optical recognition device/digital optical recognition device
6 user interface
7 control device
7*a* first memory
7*b* second memory
8 separate memory
10 quality management monitoring system
11 main switch
13 control
14 illuminating device/illuminating apparatus
15 comparator

The invention claimed is:

1. A method for detecting a cleaning need of a commercial cooking appliance with at least one cooking surface inside a cooking chamber, comprising the steps:

capturing at least one image of at least a part of the cooking surface inside the cooking chamber or at least a part of a cooking product inside the cooking chamber during a cooking process using an optical recognition device;

storing the at least one captured image in a first memory;

pre-storing a reference image of a contaminated cooking surface inside the cooking chamber requiring a cleaning or a reference image of the cooking product inside the cooking chamber in a cooking status indicating a need for cleaning the cooking surface in a second memory;

comparing the captured image in the first memory with the reference image pre-stored in the second memory using a comparator of a control device or a control; and based on the comparison, deciding whether an automatic cleaning is needed.

2. The method according to claim 1, further comprising automatically interrupting the cooking process or automatically switching off the commercial cooking appliance if a need to clean the commercial cooking appliance is detected by the control device or the control.

3. The method according to claim 2, further comprising comparing, by the control device or the control, a remaining cooking time until the completion of the cooking process with a predetermined time threshold and switching off the commercial cooking appliance only after the expiration of the remaining cooking time when the remaining cooking time is less than the predetermined time threshold.

4. The method according to claim 1, further comprising calculating a current contamination degree or determining a current contamination type based on the at least one captured image by the control device or the control.

5. The method according to claim 4, further comprising determining, by the control device or the control, an expected contamination degree or expected contamination type of the cooking surface inside the cooking chamber expected to result from a next cooking process based on the current contamination degree or the current contamination type of the cooking surface inside the cooking chamber and cleaning the cooking surface inside the cooking chamber prior to the start of the next cooking process when the expected contamination degree requires a cleaning of the cooking surface inside the cooking chamber.

6. The method according to claim 5, further comprising selecting, by the control device or the control, a cleaning program for cleaning the cooking surface inside the cooking chamber from pre-stored cleaning programs based on a factor selected from the group consisting of: the current contamination degree, the expected contamination degree, the current contamination type, the expected contamination type and any combinations of the foregoing.

7. The method according to claim 1, further comprising outputting, by the control device or the control, a warning signal if a need to clean the cooking surface inside the cooking chamber is detected.

8. The method according to claim 7, further comprising overwriting or overriding, by the control device or the control, a condition selected from the group consisting of: a switched off status of the cooking appliance, an interrupted status of the cooking process, the output warning signal, or any combinations of the foregoing when the cooking appliance is switched on again.

9. The method according to claim 1, wherein the at least one image of the cooking surface inside the cooking chamber or the cooking product inside the cooking chamber is a plurality of images captured by the optical recognition device in predetermined time intervals.

10. The method according to claim 1, wherein the at least one image of the cooking surface inside the cooking chamber or of the cooking product inside the cooking chamber is a plurality of images captured continuously by the optical recognition device.

11. The method according to claim 1, wherein the optical recognition device is a digital optical recognition device.

12. The method according to claim 4, further comprising determining, by the control device or the control, an expected contamination degree or expected contamination type of the cooking surface inside the cooking chamber expected to result from a cooking time of the next cooking process or a remaining cooking time until completion of the current cooking process.

* * * * *